US011912390B2

(12) United States Patent
Meilleur

(10) Patent No.: US 11,912,390 B2
(45) Date of Patent: Feb. 27, 2024

(54) WATER CRAFT PADDLE

(71) Applicant: Richard Meilleur, Toronto (CA)

(72) Inventor: Richard Meilleur, Toronto (CA)

( * ) Notice: Subject to any disclaimer, the term of this patent is extended or adjusted under 35 U.S.C. 154(b) by 0 days.

(21) Appl. No.: 17/169,700

(22) Filed: Feb. 8, 2021

(65) Prior Publication Data

US 2022/0250728 A1 Aug. 11, 2022

(51) Int. Cl.
*B63H 16/04* (2006.01)

(52) U.S. Cl.
CPC ..... *B63H 16/04* (2013.01)

(58) Field of Classification Search
CPC .. B63H 16/04; B63H 2016/046; A63B 31/04; A63B 31/10
USPC ..... 416/74; D12/215
See application file for complete search history.

(56) References Cited

U.S. PATENT DOCUMENTS 245,378 A * 8/1881 Hirsch ..... B63H 16/04 416/235
D578,055 S * 10/2008 Halm ..... D12/215
11,299,247 B1 * 4/2022 Staigerwald ..... B63H 16/04
2018/0133554 A1 * 5/2018 Evans ..... A63B 31/12

FOREIGN PATENT DOCUMENTS

WO WO-2013026127 A1 * 2/2013 ..... F03D 3/005

OTHER PUBLICATIONS

"Bumpy edges could be key to record-breaking oars", online article published by Science News Explores, Published May 20, 2019; available at https://www.snexplores.org/blog/eureka-lab/isef-2019-bumpy-whale-inspired-rowing-oar-might-break-records.

* cited by examiner

*Primary Examiner* — Richard A Edgar
(74) *Attorney, Agent, or Firm* — Marks & Clerk; Kevin Shipley

(57) ABSTRACT

A paddle for propelling a watercraft through water. The paddle includes an elongated shaft having a handle at one end and a paddle portion at the other end. The paddle portion includes a substantially flat member having opposite first and second sides, a central portion and a peripheral edge. A plurality of convolutions are formed on the peripheral edge of the paddle portion, with each convolution consisting of a finger positioned between a pair of notches, the notches extending from the peripheral edge towards the central portion. The shape and size of the notches and fingers can be selected to control the optimal performance of the paddle.

8 Claims, 11 Drawing Sheets

WATER CRAFT PADDLE

FIELD OF THE INVENTION

The invention relates generally to paddles for watercraft such as canoes, kayaks, row boats, dragon boats, gondolas, stand-up paddle boards, sailboats or any other watercraft which can be propelled or guided by a hand operated paddle.

BACKGROUND OF THE INVENTION

Watercraft such as canoes, kayaks, and other similar watercraft the like are usually propelled or guided by manually operated paddles. These paddles generally consist of an elongated shaft having a handle formed on one end and a paddle portion formed on the opposite end. The paddle portion generally consists of a flat member having a width much greater than the shaft. The operator propels the watercraft by plunging the paddle portion through the water while holding onto the shaft and handle portion. In the case of watercraft like gondolas, the paddle portion remains submerged at all times and the operator propels the craft by oscillating the paddle portion through the water. The paddle portion propels the water craft by several different means. There is the force created by the paddle as it pushes against the water as it is pulled through the water. The act of pulling the paddle portion through the water also creates vortices in the water adjacent the peripheral edges of the paddle portion. These vortices play a part in propelling the watercraft and controlling the movement of the paddle portion through the water. Where the operator propels the water craft by oscillating the paddle portion while it's in the water, vortices are likewise formed as the paddle moves through the water. Steering the watercraft is also often accomplished by the paddle by a variety of means such as using the paddle as a rudder (as in the case of a sailboat, dory or gondola) or by means of using a "J-stroke" type of paddle maneuver. Different paddle portion shapes and different stroking movements of the paddle can be used to manipulate the vortices in the water caused by the action of the paddle portion, which in turn can effect the efficiency of the paddle and easy of using the paddle to control the movement of the watercraft. An improved paddle design which attenuates and controls the formation and propagation of the water vortices created by the paddle can lead to a paddle with improved performance.

SUMMARY OF THE INVENTION

In accordance with one aspect of the present invention, there is provided an improved paddle for propelling a watercraft through water. The improved paddle includes an elongated shaft having a handle at one end and a paddle portion at the other end. The paddle portion includes a substantially flat member having opposite first and second sides, a central portion and a peripheral edge. A plurality of convolutions are formed on the peripheral edge of the paddle portion, with each convolution consisting of a finger or protuberance positioned between a pair of notches, the notches extending from the peripheral edge towards the central portion. The shape, size and pattern of the notches and fingers (protuberances) can be selected to control the optimal performance of the paddle and to make the paddle itself lighter. Hence, different paddles can be produced which are tailored for different paddling situations and for paddlers having different paddling skills, strength and endurance.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

In the drawings like characters of reference indicate corresponding parts in the different figures.

DETAILED DESCRIPTION OF THE INVENTION

Figure 3:
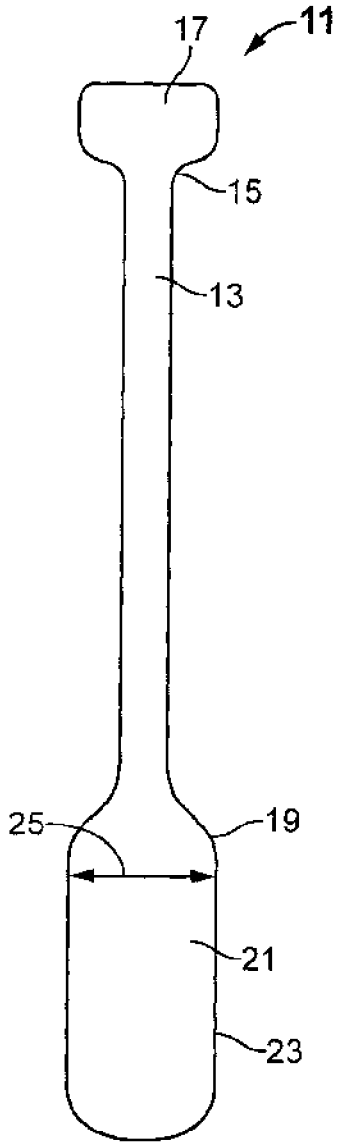
FIG. 3 Prior Art
FIG. 3 is a front view of a prior art watercraft paddle.

Referring firstly to FIG. 3, a prior art paddle shown generally as item 11 consists of an elongated member having shaft 13 with opposite ends 15 and 19. Handle portion 17 is formed on end 15 and paddle portion 21 is formed on end 19. Paddle portion 21 consists of a substantially flat member having a width 25 which is significantly wider than shaft 13 to permit the paddle to generate a drag force when paddle portion 21 is pulled through the water. Paddle portion 21 has a peripheral edge 23 which extends along the entirety of paddle portion 21. The width 25 of paddle portion 21 can vary depending on the shape of the paddle portion. Also, while a symmetrical paddle portion 21 is illustrated in FIG. 3, it will be appreciated that paddle portion 21 may be made asymmetrical depending on the intended use of the paddle.

Figure 1:
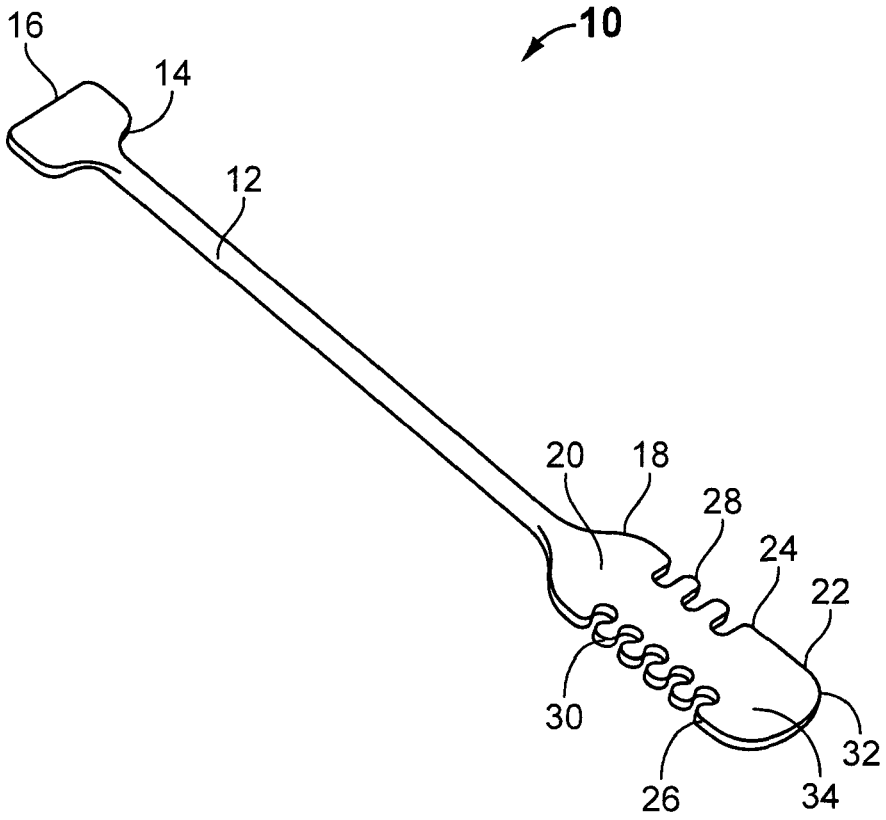
FIG. 1 is a perspective view of a watercraft paddle made in accordance with the present invention.
Figure 2:
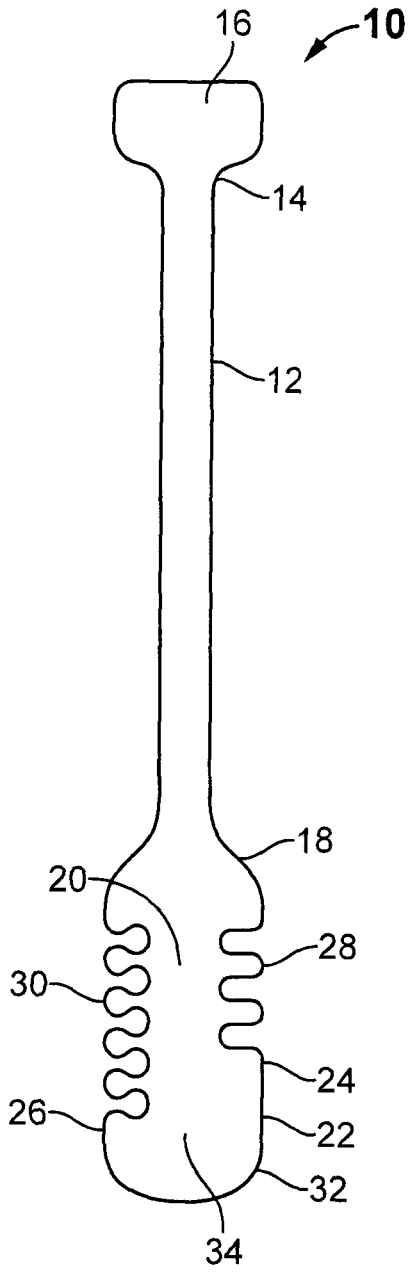
FIG. 2 is a front view of the watercraft paddle shown in FIG. 1.

Referring to FIGS. 1 and 2, a paddle made in accordance with the present invention is shown generally as item 10. Similarly to prior art paddle 11, paddle 10 includes an elongated shaft 12 having opposite ends 14 and 18 with handle portion 16 formed at end 14 and paddle portion 20 formed at end 18. Paddle portion 20 has a peripheral edge 24 surrounding a central portion 34. Paddle portion 20 is a flat member having opposite side edges 22 and 26 and convoluted portions 28 and 30 separated by smooth portion 32. Paddle 10 may have only one convoluted portion or it may have more than two convoluted portions, depending on the desired properties of the paddle.

Figure 4:
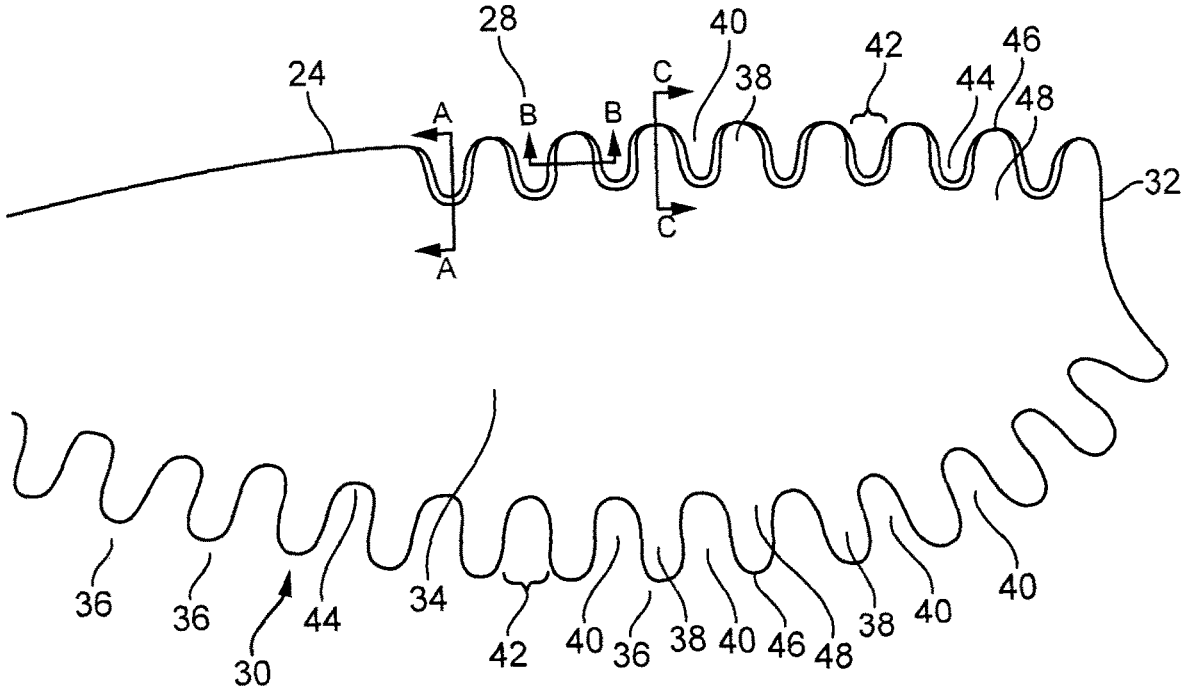
FIG. 4 is a front view of a paddle portion of an alternate embodiment of a watercraft paddle made in accordance with the present invention.

Referring now to FIG. 4, each convoluted portion includes a plurality of convolutions 36 which are formed adjacent one another. Each convolution 36 consists of a projecting finger 38 which is positioned between a pair of notches 40. If the convolutions are immediately adjacent each other as in the embodiment shown in FIG. 4, then the notches and fingers alternate along the length of portions 28 and 30 in a way reminiscent of a sine wave or square wave. Each finger 38 has a terminal end 46 which extends away from central portion 34 and a base portion 48 which is oriented towards central portion 34. Each notch 40 has an open end 42 oriented away from central portion 34 and a closed end 44 oriented towards central portion 34. It will be appreciated that fingers 38 and notches 40 can have a variety of shapes as may be desired. Fingers 38 can have terminal ends 46 which are rounded as illustrated in FIG. 4 but the terminal ends could be bulbous, squared off, pointed, or angular. Likewise, notches 40 can shaped such that closed end 44 is rounded as illustrated in FIG. 4, but they could also be bulbous, squared off, angular, pointed or V shaped.

Figure 5:
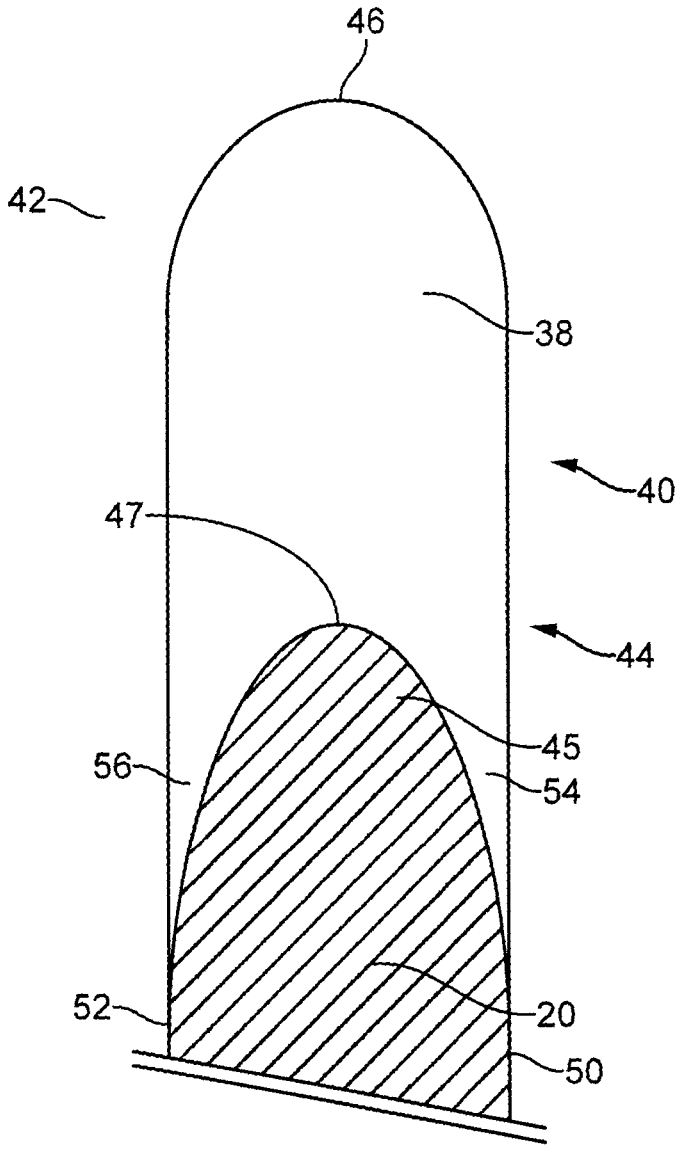
FIG. 5 is a sectional view taken along line A-A in FIG. 4.

Referring now to FIG. 5, each convolution consists of a finger 38 positioned between a pair of notches 40. The closed end 44 of each notch meets up with axial portion 45 of the peripheral portion of the paddle member. Axial portion 45 is essentially the end of the peripheral portion of the paddle member which defines closed end 44 of the notch. Axial portion 45 preferably tapers in thickness such that point 47 at the end of the axial portion is thinner. This tapering of the axial portion necessarily forms sloped portions 54 and 56. The tapering of the axial portion and the positioning sloped portions 54 and 56 permits water to flow through notch 40 with less turbulence because there is a relatively smooth transition between faces 50 and 52 of paddle portion 20 at notch 40. If axial portion 45 is not tapered, then there is a sharper transition between faces 50 and 52 which would cause more turbulence. Also, it is possible to make the angle of slope 54 different than slope 56 such that the slopes are steeper on one side as opposed to the other. Different slopes can result in changes to how water flows through notches 40 as the paddle is pulled through the water. The amount and nature of turbulence relating to notch 40 can therefore be selected simply by selecting the specific profile of axial portion 45.

Figure 6:
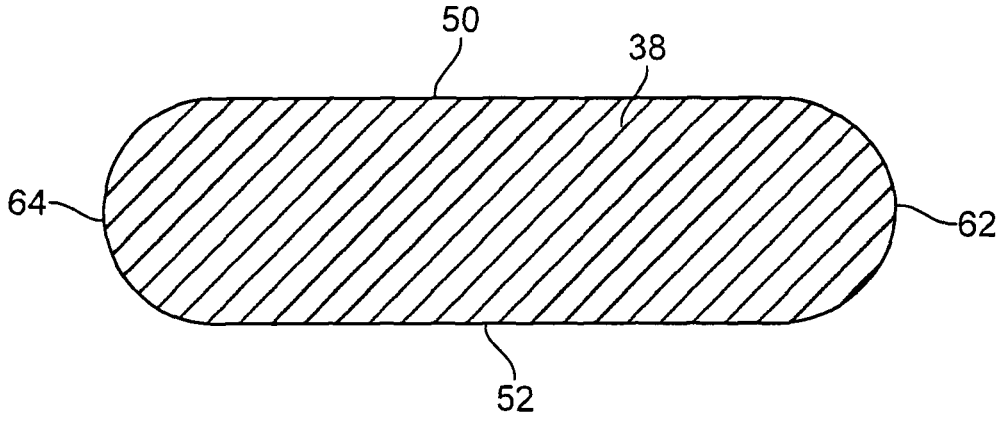
FIG. 6 is a sectional view taken along line B-B in FIG. 4.

Referring now to FIG. 6, finger 38 has a width determined by side edges 62 and 64. Side edges 62 and 64 can be tapered such that there is a smooth and gradual transition between faces 50 and 52. If side edges 62 and 64 are tapered as illustrated, then water can flow around finger 38 with less turbulence; however, in some applications it may be desirable to have side edges 62 and 64 squared off to leave a sharp transition between faces 50 and 52. Alternatively, edges 62 and 64 can be profiled such that the edges are steeper towards one of the faces as compared to the other. Hence, the nature of the flow of water around finger 38 can be controlled by carefully selecting how edges 62 and 64 are profiled.

Figure 7:
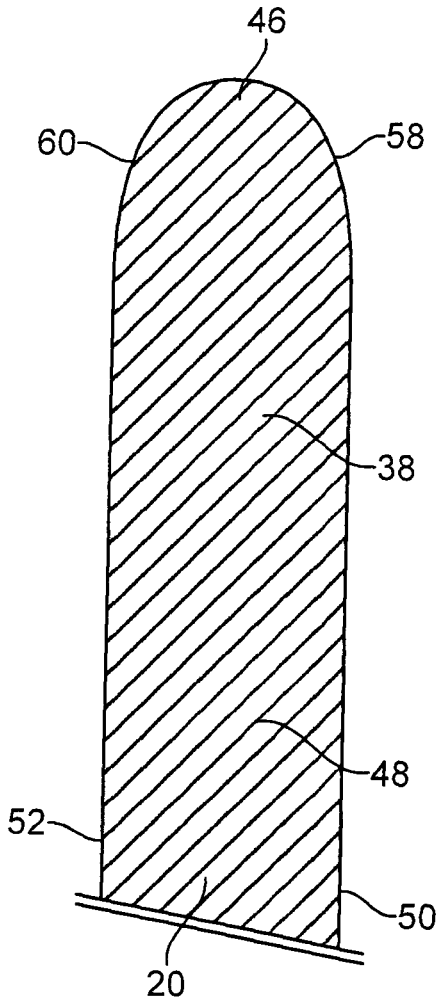
FIG. 7 is a sectional view taken along line C-C in FIG. 4.

Finger 38 has a terminal end 46 which can have different profiles as desired as can be seen in FIG. 7. Terminal end 46 can be tapered to form sloped walls 58 and 60, with sloped wall 58 oriented on the same side as face 50 of paddle portion 20 and sloped wall 60 oriented on the same side as face 52 of the paddle portion. If terminal end 46 is tapered as shown in FIG. 6, then there is a gradual transition from face 50 to face 52 at the terminal end and water can flow in a more laminar fashion along the slopes between faces 50 and 52 as the paddle is pulled through the water, resulting in less turbulence and vortices formed at the terminal end. However, in some applications, it may be more desirable to profile terminal end 46 in a "squared" configuration so that there is an abrupt transition between faces 50 and 52. Also, it is possible to profile terminal end 46 such that one of sloped walls 58 and 60 is steeper than the other, which will result in a different flow pattern of water adjacent finger 38 as the paddle is forced through the water. Hence, the pattern of the flow of water adjacent finger 38 can be specifically tailored simply by selectively profiling the finger.

Figure 8:
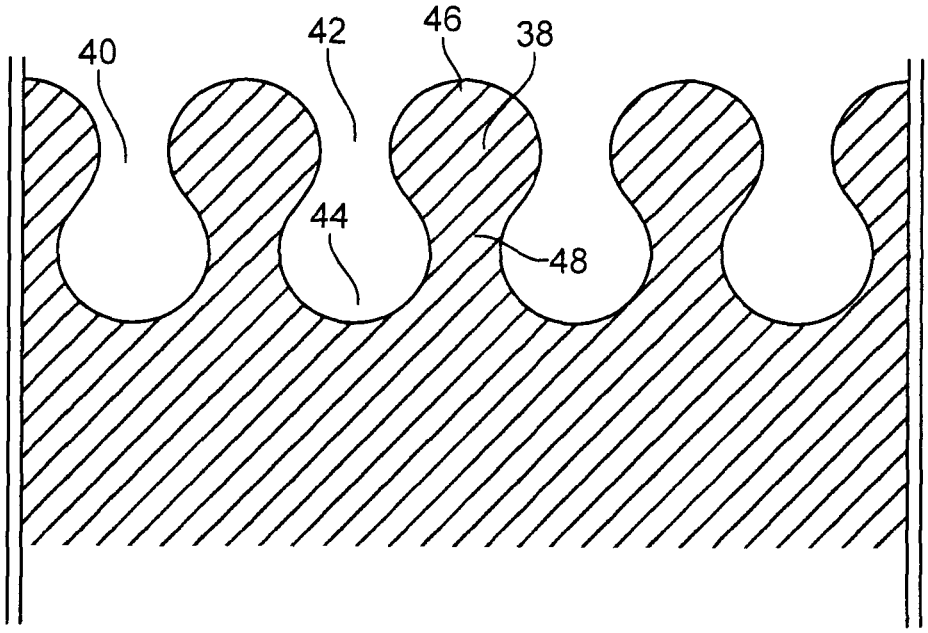
FIG. 8 is a sectional view of convoluted portion 30 of the watercraft paddle shown in FIG. 2.
Figure 9:
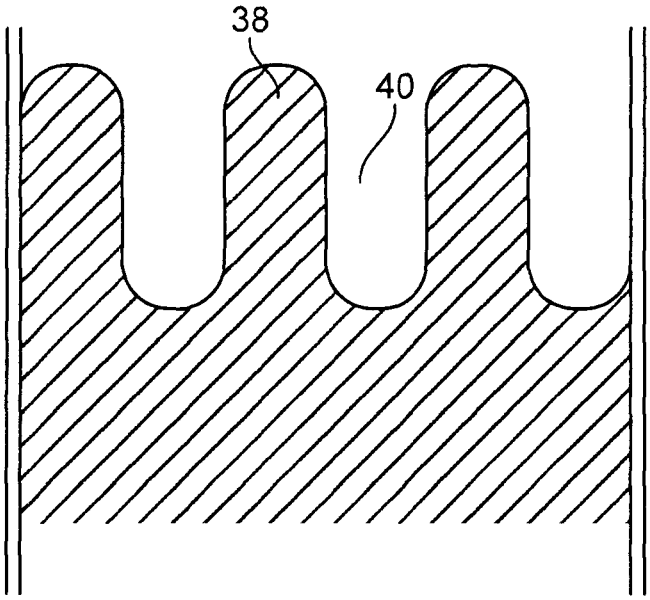
FIG. 9 is a sectional view of convoluted portion 28 of the watercraft paddle shown in FIG. 2.

Referring now to FIG. 8, each finger 38 and notch 40 has a diameter. The diameter of notch 40 could be substantially equal from closed end 44 to open end 42, or as seen in FIG. 8, the diameter of the notch could be greater at closed end 44 and it is at open end 42. Likewise, finger 38 has a diameter which could be substantially equal from base 48 to terminal end 46, or as seen in FIG. 8, the diameter of finger 38 could be narrower at base 48 and wider at terminal end 46. In the orientation shown in FIG. 8, water has a wider channel to pass through at closed end 44 and a narrower channel to pass through at open end 42, therefore the flow of water will be different through the convolutions shown in FIG. 8 than through the convolutions shown in FIG. 9 where the diameters of fingers 38 and notches 40 are substantially equal and uniform. Both types of convolutions can be found on the same paddle depending on the needs of the user.

Figure 10:
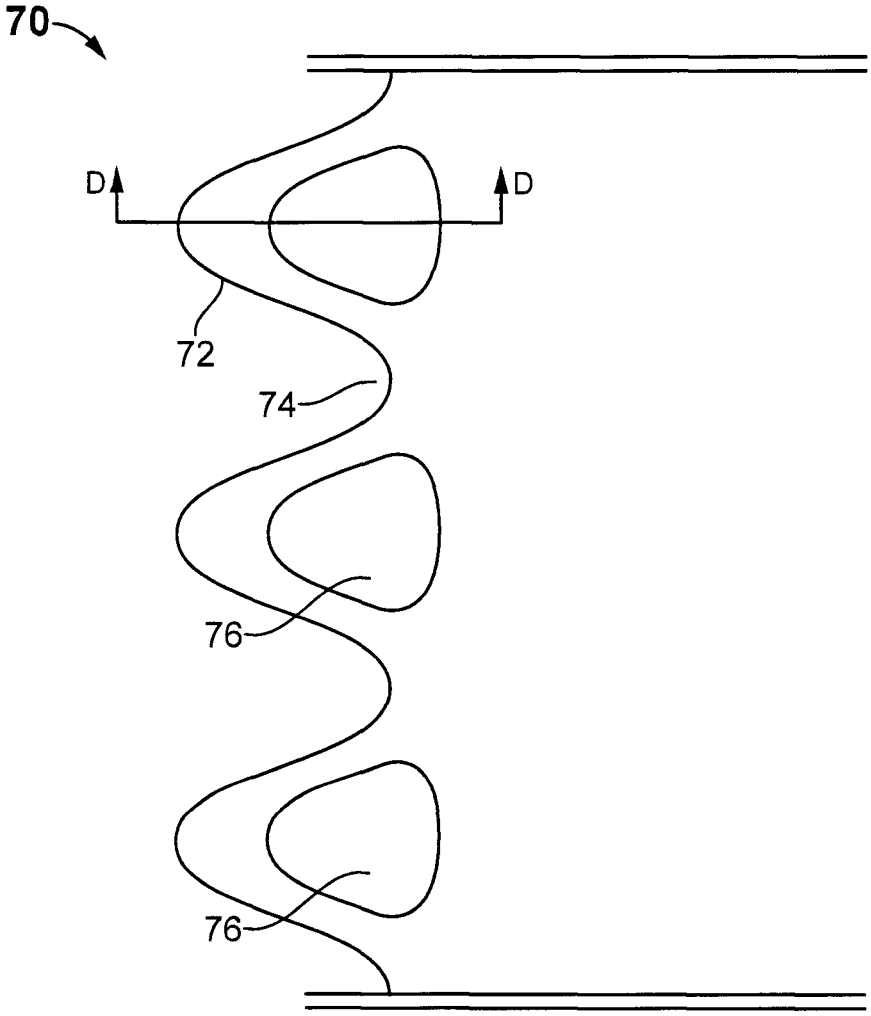
FIG. 10 is a front view of a convoluted portion of an alternate embodiment of a watercraft paddle made in accordance with the present invention.

Referring now to FIG. 10, the convolutions can be combined with concave portions adjacent the convolutions to create a different set of water flow characteristics for the paddle. Paddle portion 70 has a series of convolutions having fingers (protuberances) 72 separated by notches 74. Concave portions 76 are formed on and adjacent to protuberances 72. The concave surfaces are separated from each other by a space which is not concave such that the peripheral edge of the paddle portion is scalloped with a plurality of concaves surfaces separated by a plurality of non-concave surfaces. Concave portions 76 are aligned with the protuberances 72 and the non-concave surfaces between the concave portions are aligned with notches 74.

Figure 11:
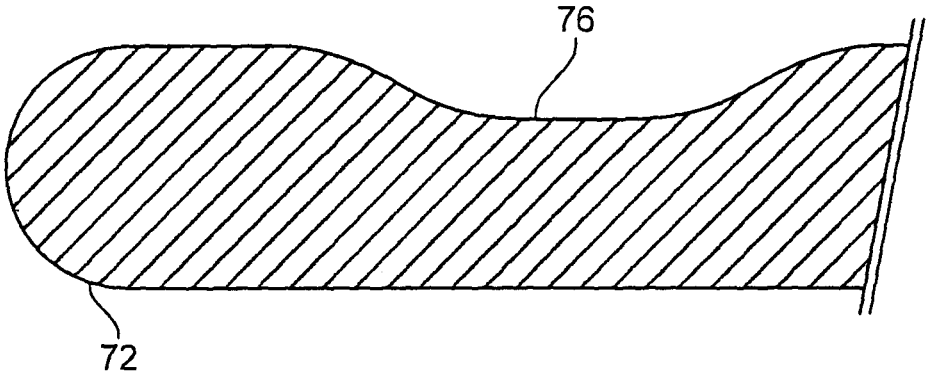
FIG. 11 is a sectional view taken along line D-D in FIG. 10.

As better seen in FIG. 11, concave portion 76 can be formed as part of finger 72. Water flowing around finger 72 encounter concave surface 76 which, depending on the dimensions and configuration of concave surface 76, will result in a different flow of water at the concave surface as the paddle is pulled through the water. The water vortices and eddies which form around finger 72 as the paddle is pulled through the water can be subtly controlled by the dimensions of concave surface 76. Referring back to FIG. 10, careful selection of the dimensions of fingers 72, notches 74 and concave surfaces 76 can add additional performance characteristics to paddle 70.

Referring back to FIG. 1, the present invention allows the manufacture of improved watercraft paddles which are not only lighter but also easier and more precise to use. By carefully selecting the pattern, shape, and dimensions of the fingers, notches and concave surfaces, the precise water flow around the paddle portion can be controlled. The pattern of convolutions can be used to control the water flow around the paddle portion allowing for the manufacture of custom paddles tailored for different users and different situations. The pattern of convolutions can be used to produce a paddle having lower weight due to the removal of material between the fingers of the convolutions. The lighter paddle will also have improved performance and improved stability as the paddle is pulled through the water. Different patterns of convolutions can be tailored for paddles adapted for different uses. Hence, a paddle intended to be used with white water canoeing where precise powerful strokes are often required will have a different pattern of convolutions than a paddle intended to be used with a canoe intended to be paddled across calm lakes and rivers over long distances. The pattern of convolutions can also be used to tailor the paddle to the user, with paddles intended for use with casual users having different convolution patterns than paddles intended for use with professional paddles or elite athletes. The pattern of convolutions can also be formed by means of well known wood working techniques (in the case of wooden paddles) or the convolutions can be built into the mold in the case of molded plastic paddles.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims Therefore, what is claimed is:

1. A paddle for propelling a water craft through water, the paddle comprising;

an elongated shaft having a handle at one end and a paddle portion at the other end;

the paddle portion comprising a substantially flat member having opposite first and second sides, a central portion and a peripheral edge, a plurality of convolutions formed on the peripheral edge, each convolution comprising a finger positioned between a pair of notches, the notches extending from the peripheral edge towards the central portion, and a plurality of concave surfaces formed on the peripheral edge adjacent the convolutions, the concave surfaces aligning with the fingers, the plurality of concave surfaces being separated from each other by a plurality of non-concave surfaces, respectively, the non-concave surfaces being aligned with the notches.

2. The paddle defined in claim 1 wherein the plurality of convolutions are positioned adjacent each other along a length of the peripheral edge.

3. The paddle defined in claim 1 wherein each of the fingers have a width and each of the notches have a width, the width of the fingers being substantially equivalent to the width of the notches.

4. The paddle defined in claim 1 wherein the paddle portion has thickness adjacent the peripheral edge, the notches having an open end oriented away from the central portion and a closed end oriented towards the central portion, the thickness of the peripheral edge tapers at the closed end.

5. The paddle defined in claim 4 wherein the fingers have a terminal end oriented away from the central portion and opposite side edges, the thickness of the peripheral edge tapering at the terminal end and the opposite side edges.

6. The paddle defined in claim 1 wherein the fingers have a terminal end oriented away from the central portion, a base towards the central portion, opposite side edges and a width between the side edges, the width of the fingers being greater at the terminal end than at the base.

7. The paddle defined in claim 6 wherein the notches have an open end oriented away from the central portion and a closed end oriented towards the central portion, the notches having a width which is greater at the closed end than at the open end.

8. The paddle defined in claim 1 wherein the plurality of convolutions are formed on the opposite first and second sides of the paddle portion and are spaced apart by the substantially flat member.

* * * * *